United States Patent [19]

Braverman

[11] 4,122,651

[45] Oct. 31, 1978

[54] APPARATUS AND METHOD FOR FILLING MEDICINAL DISPENSING DEVICES

[76] Inventor: Milton Braverman, 640 Wynmill Pl., Philadelphia, Pa. 19115

[21] Appl. No.: 838,190

[22] Filed: Sep. 30, 1977

[51] Int. Cl.[2] ..... B65B 3/00; B65B 67/00

[52] U.S. Cl. ..... 53/390; 53/471; 141/247

[58] Field of Search ..... 53/35, 37, 235, 266, 53/268, 281, 282, 287, 299, 329, 390; 141/237, 238, 240, 246, 247, 391

[56] References Cited

U.S. PATENT DOCUMENTS

| | | | |
|---|---|---|---|
| 244,308 | 7/1881 | Reymond | 141/247 |
| 693,637 | 2/1902 | Brethour | 141/247 |
| 928,356 | 7/1909 | Brown | 141/247 |
| 1,488,603 | 4/1924 | Kouwenhoven | 141/238 |
| 3,566,929 | 3/1971 | Mead | 141/247 X |
| 3,754,374 | 8/1973 | Haines | 53/390 X |
| 3,780,856 | 12/1973 | Braverman | 206/461 |

*Primary Examiner*—Robert Louis Spruill
*Attorney, Agent, or Firm*—Caesar, Rivise, Bernstein & Cohen, Ltd.

[57] ABSTRACT

Apparatus and a method for filling and sealing a medicinal dispensing device with a flowable material, such as a liquid, and for sealing the liquid therein. The medicinal dispensing device includes a base having plural chambers each surrounded by a flange. A closure is adhesively secured to the base by contacting the flanges to seal the material within the chambers. The apparatus for filling and sealing the medicinal dispensing device comprises a base support block having an extending channel in the top face and a plurality of spaced recesses within the channel. The recesses are so dimensioned and spaced from each other to receive respective chambers of the base, with portions of the channel between the recesses supporting the flanges of the base. Removable guide means in the form of an elongated block is disposed within the channel over the flanges of the device base. The guide means includes plural funnel-shaped openings tapering downward and being spaced such that when the guide means is disposed within the channel each funnel-shaped opening overlies a respective chamber of the base of the medicinal dispensing device for directing the flowable material into the chamber while preventing the material from contacting the contiguous flange. The guide member is removable to enable the closure to be placed over the filled base. A press having a work contacting surface configured to fit within the channel is provided to force the closure of the device into engagement with the flanges of the base to seal the closure onto the base. Locating pins are provided for facilitating the insertion of the closure directly over the base.

10 Claims, 7 Drawing Figures

APPARATUS AND METHOD FOR FILLING MEDICINAL DISPENSING DEVICES

This invention relates generally to medicinal dispensing packaging and more particularly to apparatus for filling and sealing unit does medicinal dispensing devices with a flowable material.

In my U.S. Pat. No. 3,780,856 there is disclosed a unit dose medicinal dispensing packing or device which can be readily loaded with medicaments such as tablets, capsules, and the like by hospital or other personnel and which provides an effective means for dispensing such material on a unit dose basis. To that end, the device is in the form of plural separable compartments, each compartment adapted to hold a unit dose of medicine therein. The device basically includes a base member and a closure therefore. The base comprises a plurality of flanges having corners which are detachably connected along perforated lines so that each flange may be separated from the remaining flanges. A chamber with an outer opening depends from each flange. The chamber is adapted to receive and hold a unit dose of medicine, e.g., pill, capsule, tablet, etc., therein. The closure is in the form of a continuous member covering the chamber openings, with certain portions of the interior surface of the closure being in contact with the flanges. The closure member is perforated along lines which closely correspond to the perforated flange lines so that respective portions of the closure seal respective chambers. The portions of the interior surface of the closure which make contact with the flanges include an adhesive coating to secure the closure to the flanges. The portions of the closure overlying the chambers do not carry an adhesive and are not tacky. At least one corner of each flange is removed in a cut-away area so that the associated corner of the closure portion overlies the cut-away area to function as a lift tab to facilitate its separation from the associated flange to provide access to the contents of the chamber.

In my U.S. Pat. No. 3,924,748 there is disclosed an another medicinal dispensing device particularly suitable for providing unit doses and constructed similar to the device of my U.S. Pat. No. 3,780,856 except for its closure.

My above described medicinal dispensing devices are preferably filled with their contents by placing the base portion thereof within a fixture like that disclosed in my first mentioned patent. The fixture includes a base having an array of openings corresponding to the array of chambers in the medicinal dispensing device. The base of the medicinal dispensing device is mounted on the fixture with each opening receiving a respective chamber of the base of the medicinal dispensing device. The unit doses are inserted within the chambers, the closure disposed over the base and then pressed into contact therewith by the use of a pressure applying member or pad. This causes the adhesive surfaces of the closure to make intimate contact with the underlying flanges, thereby sealing the unit doses in their respective compartments.

The above described fixture and technique for using the same is quick, effective and reliable to seal solid medicines such as tablets, capsules, pills and the like within the compartments of a unit dose medicinal dispensing device. However, when attempting to seal liquids or other flowable materials, such as powders, into such devices extreme care must be taken to avoid any spillage of the flowable materials onto the flanges of the base member since the presence of any such materials on the flanges may impede the adhesion of the closure member thereto.

Accordingly, it is a general object of the instant invention to provide apparatus and a method for filling unit dose medicinal dispensing devices with flowable materials.

It is a further object of this invention to provide apparatus for filling medicinal dispensing devices with liquids or other flowable materials quickly, easily and reliably.

It is still a further object of this invention to provide apparatus which is simple in construction, low in cost, yet effective for filling medicinal dispensing devices with liquids or other flowable materials quickly, easily and reliably.

It is yet a further object of this invention to provide a method for filling unit does medicinal dispensing devices with flowable materials.

These and other objects of the instant invention are achieved by providing a method and apparatus for filling a medicinal dispensing device with flowable material. The medicinal dispensing device includes a base having plural chambers, each of which is surrounded by flanges and a closure for adhesive securement to the base, via contact with the flanges, to seal the material within the chambers. The apparatus for filling the device comprises a base support block having an extending channel in the top surface thereof and a plurality of recesses spaced along the channel. The recesses are so dimensioned and spaced from one another to receive respective chambers of the medicinal dispensing device therein, with the portions of the channel contiguous with the recesses supporting the flanges of the device base. Removable guide means are provided in the form of an elongated block dimensioned to fit within the channel and over the flanges contiguous with each of the chambers. The guide means includes a top and bottom face with plural funnel-shaped openings extending therebetween and tapering down from the top face to the bottom face. The openings are spaced from one another so that when the guide means is disposed within the channel with its bottom face in contact with the flanges of the device base each funnel-shaped opening overlies the center of a respective chamber of the base. Each opening is arranged to direct a flowable material therethrough into the chamber disposed therebelow while preventing the material from contacting the contiguous flanges. Once the material is within the chambers of the base a closure is disposed over the base within the channel and is secured to the underlying flanges, via the application of pressure applied from a press in the form of an elongated member having a contact face configured to fit within the channel.

Other objects and many of the attendant advantages of the instant invention will be readily appreciated as the same becomes better understood by reference to the following detailed description when considered in connection with the accompanying drawing wherein.

Figure 1:
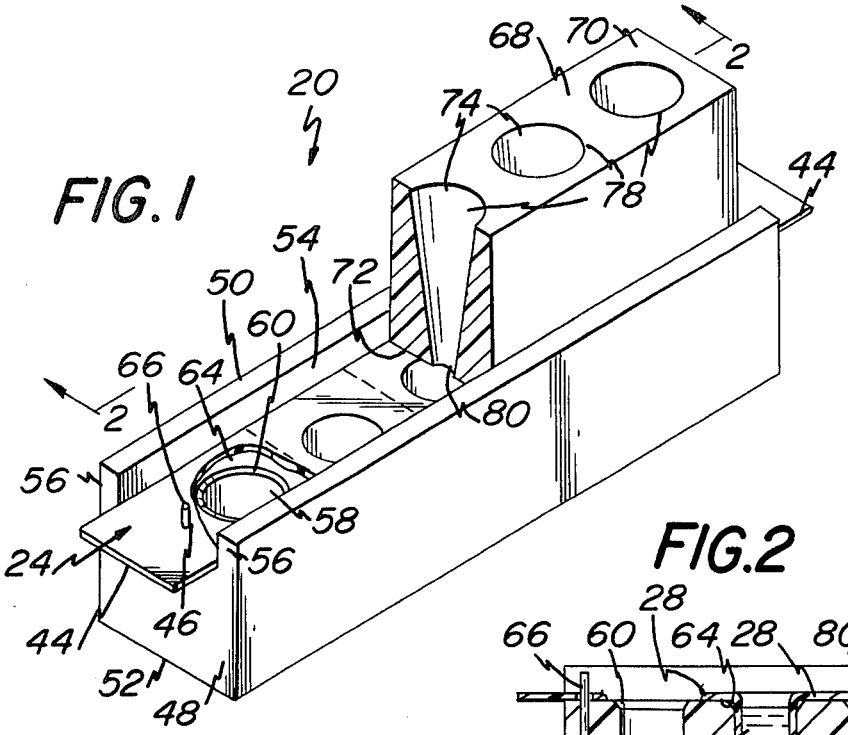
FIG. 1 is a perspective view, partially in section, showing the apparatus of the instant invention arranged for filling the chambers of a multi-compartment medicinal dispensing device.

Referring now to the various figures of the drawing wherein like reference characters refer to like parts, there is shown generally at 20 in FIG. 1 apparatus for filling and sealing a multi-compartment medicinal dispensing device 22.

Figure 6:
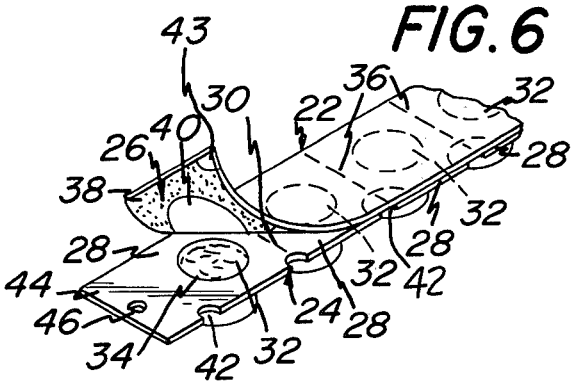
FIG. 6 is a perspective view of an exemplary multi-compartment medicinal dispensing device which can be filled with liquids or other flowable materials by the apparatus of the instant invention.

The dispensing device 22 is shown clearly in FIG. 6 and is constructed in accordance with various teachings of my above identified patents. To that end, the medicinal dispensing device 22 includes a base 24 and a closure 26. The base comprises a plurality of flanges 28 which are detachably connected to one another along perforated lines 30 so that each flange may be separated from the remaining flanges. A chamber 32 having an outer opening 34 depends from each flange. The chamber is adapted to receive and hold a unit dose of a flowable medicine. The closure 26 is a continuous member which covers the chamber openings and is divided into plural sections which are connected to one another along perforated lines 36. The lines 36 correspond to the perforated flange lines 30. The undersurface of the closure includes portions having an adhesive 38 thereon. The adhesive portions of the closure are adapted to make contact with the flanges 28 of the base portion. The central portion of each section of the closure, that is the portion of the section immediately overlying the opening of an associated chamber, is denoted by the reference numeral 40, and does not have any adhesive thereon to provide a non-tacky cover for the chamber.

One corner of each flange of the base 24 is removed in a cut-away portion 42. A corresponding corner 43 of the closure 26 does not have any adhesive thereon. The non-adhesive corner 43 of the closure overlying the cut-away portion 42 of the base thus serves as a convenient lift tab to facilitate the separation of its closure section from the underlying flange to provide access to the contents of the chamber 32.

In accordance with a preferred aspect of the invention the medicinal dispensing devices 22 are constructed so that their end compartments include enlarged extending end flanges 44 each having an opening 46 therein. The reason for such a construction will be described in detail later. In addition, the base 32 of the device is preferably formed of polyvinyl chloride or high impact polyethylene or polypropylene and has a coating of SARAN (polyvinylidene chloride) or MYLAR (polyester) on its interior surface to render the device 22 suitable for holding viscous liquids or liquids that will attach plastics.

As can be seen in FIG. 1, the apparatus 20 comprises an elongated base support block 48 having a top face 50 and a bottom face 52. An elongated channel 54 is cut in the top face and extends the full length of the block 48. Disposed at each side of the channel is a respective side wall 56. The channel is arranged to receive the base 24 of the adhesive dispensing device 22 therein. To that end, the width of the channel, that is the distance between the side walls 56 is just slightly greater than the width of the base 24 of the device 22.

Figure 2:
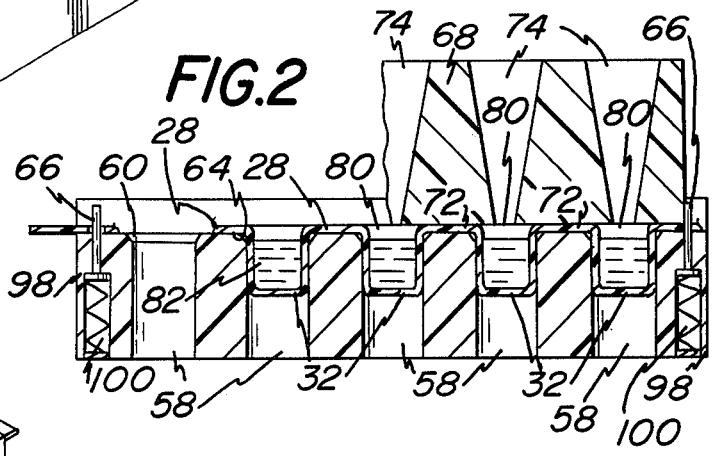
FIG. 2 is a sectional view taken along line 2—2 of FIG. 1.
Figure 3:
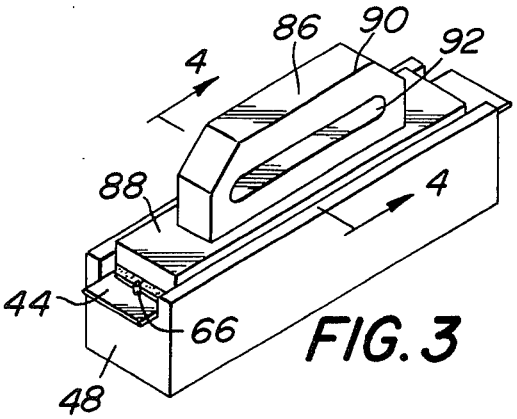
FIG. 3 is a perspective view of the apparatus of the instant invention shown sealing the closure onto the base of a filled multi-compartment medicinal dispensing device.

As can be seen in FIGS. 1 and 2, the base support block 48 includes a plurality of recesses 58. The recesses are aligned longitudinally and are equidistantly spaced by the distance separating the chambers 32 of the base member 24 of the dispensing device. The mouth of each of the recesses 58 is chambered at 60 (FIG. 2). Each recess 58 is adapted to receive therein a respective chamber 32 of the base 24, while the bottom surface 64 of the channel 54 contiguous with the recesses supports the contiguous flanges 28 of the base. A pair of locating pins 66 project upward from the channel 54 at each end thereof to extend through the respective openings 46 at the end base member 24 when the base is located within the channel. The remaining portion of each enlarged end flange 44 of the base member jut outward from the base 48 to provide a respective grasping tab at each end of the base.

Once the base 24 of the dispensing device 22 has been located within the base support block 48 as shown in FIG. 1, it is ready for filling.

In order to ensure that each of the compartments 32 of the device is filled quickly, easily and without danger of spillage onto the flanges, a pouring guide 68 is utilized. The guide 68 is an elongated block-like structure having a top surface 70 and a bottom surface 72. The block is sufficiently wide so that it just fits within the channel 54 between the walls 56.

As can be seen in FIGS. 1 and 2, the guide 68 includes plural funnel-shaped openings 74. The openings taper downward from a large diameter mouth 78 at the top surface 70 to a small diameter outlet 80 in the bottom surface 72. The funnel-shaped openings 74 are longitudinally spaced equidistantly along the block such that each outlet 80 overlies the center of a respective chamber 32 of the base 24 disposed in the base support block 48.

When the guide block 68 is in the position shown in FIGS. 1 and 2, a liquid 82 or other flowable material can be poured into each of the funnel-shaped openings 74 and thus directed into the underlying chamber 32. Since the outlets 80 are centered over the chambers 32 the liquid 82 is directed into the underlying chamber while the bottom surface 72 of the guide block 68 covers the contiguous flanges, thereby preventing any liquid from contact therewith. Once the liquid has completely flowed through the funnel-shaped openings and into the underlying chambers the guide block is removed to ready the apparatus for sealing a closure onto the base.

Figure 5:
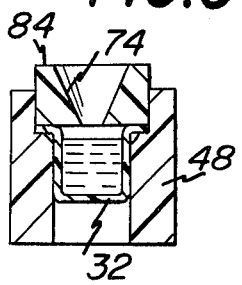
FIG. 5 is a sectional view of an alternative embodiment of the instant invention.

In accordance with the teachings of this invention various other guide blocks having different sized and tapered holes 74 may be utilized, depending upon the volume of material to be inserted into the chambers 32, the viscosity or flow rate of the material, or other factors. To that end, in FIG. 5 there is shown in cross-sectional view another embodiment of a guide block of the instant invention. As can be seen therein, guide block 84 is shorter in height than guide block 68 and has a greater taper in its funnel-shaped openings 74.

The sealing of the closure 26 onto the filled base 24 is accomplished by the apparatus 20 as follows: the guide block 68 is removed from the channel 54 and an adhesive closure 26 is inserted in the channel over the base 24 and between the pins 66. The pins 66 serve as locating pins to ensure that the closure is precisely located with respect to the base, whereupon the perforated lines 36 of the closure overlie and are aligned with the perforated lines 30 of the base.

Figure 4:
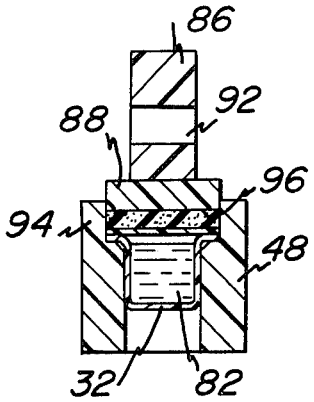
FIG. 4 is an enlarged sectional view taken along line 4—4 of FIG. 3.

In accordance with a preferred aspect of this invention it is desirable to apply pressure evenly over the entire closure 26 to seal it to the underlying base 24. To that end, a press member 86 is utilized. The press member comprises an elongated bar 88 having a handle 90 secured to the rear side thereof. The handle includes an opening 92 for receipt of the user's fingers. The bar 88 has a pressure pad 94 (FIG. 4) in the form of a rubber or other resilient pad secured to its front or working surface 96.

While the bar 88 and its resilient contact pad 94 are shown being only as long as the distance between the locating pins 66, it is to be understood that the bar and its resilient contact face may extend the full length of the channel 54, depending upon the length of the closure 26 to be sealed on the base 24.

In accordance with a preferred embodiment of the invention the locating pins 66 are spring loaded (see FIG. 2). To that end, each of the pins 66 is disposed within a bore 98 in the base support block 48. A biasing spring 100 is also located within the bore and is adapted to extend the spring outward to the position shown in FIG. 2.

Once the medicinal dispensing device 22 has been filled and sealed as described above the press 86 is removed from the channel 54 and the sealed medicinal dispensing device 20 is lifted from the channel, by grasping the enlarged flanged ends 44.

Figure 7:
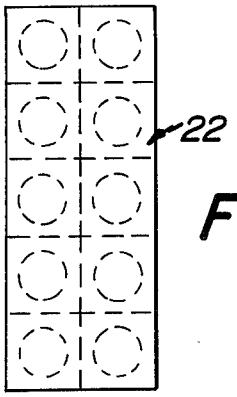
FIG. 7 is a top view of another multi-compartment medicinal dispensing device which can be filled with liquids or other flowable materials by the apparatus of the instant invention.

While the drawing shows the apparatus 20 arranged for filling and sealing a dispensing device 22 having only a single row of chambers, it is clear that in accordance with the teaching of the instant invention the device can be modified to fill and seal dispensing devices having plural rows of chambers. In this regard, in FIG. 7 there is shown a top view of a two row dispensing device 22 which can be filled by the filling and sealing apparatus of the instant invention.

It should be pointed out at this juncture that the apparatus of the instant invention may be formed of any liquid impervious, readily sanitizable material although it is preferred that such material be plastic.

As should be appreciated by those skilled in the art the apparatus and method of the instant invention is eminently suitable for industrial applications owing to the speed, accuracy and reliability for filling and sealing unit dose medicinal dispensing devices which this invention exhibits.

Without further elaboration, the foregoing will so fully illustrate my invention that others may, by applying current or future knowledge, readily adapt the same for use under various conditions of service.

What is claimed in the invention is:

1. Apparatus for filling a medicinal dispensing device with a flowable material, said device including a base having plural chambers for direct receipt of said flowable material therein, each of said chambers being surrounded by flanges and a closure for adhesive securement to said base via contact with said flanges to seal said material within said chambers, said apparatus comprising press means, a base support block having a longitudinally extending channel in a top surface thereof formed between a pair of sidewalls, said channel having a plurality of recesses spaced therealong, said channel being dimensioned to closely receive the device base therein, with said sidewalls aligning the device base within said channel, the recesses in said block being dimensioned and spaced from one another to receive respective chambers of the device therein, with the portions of the channel contiguous with the recesses supporting the flanges of the device base, and removable guide means in the form of an elongated block dimensioned to fit within said channel completely over and covering the flanges contiguous with each of said chambers, said guide means including a top and a bottom face with plural funnel-shaped openings extending therebetween and tapering down from the top face to the bottom face, said openings being spaced from one another so that when the guide means is disposed within the channel with its bottom face in contact with the flanges of the device base each funnel-shaped opening overlies the center of a respective chamber of said base, each opening being arranged to direct a flowable material therethrough and into the chamber disposed therebelow while preventing such material from contacting the contiguous flanges, said sidewalls aligning the device closure within said channel and over the device base after said chambers have been filled, said block including a pair of locating pins located adjacent opposite ends of the channel and extending through openings in the device base and engaging portions of the device closure between the pins to precisely position the device closure longitudinally over the device base, said press means being in the form of an elongated member having a contact face configured to fit closely within said channel to secure the closure to the underlying flanges by applying pressure to force said closure into engagement with said flanges once the chambers have been filled, the guide means removed and the closure inserted within the channel.

2. The apparatus of claim 1 wherein said flowable material is a liquid and wherein said guide means is formed of a liquid resistant material.

3. The apparatus of claim 2 wherein said liquid resistant material is plastic.

4. The apparatus of claim 1 wherein the base of the medicinal dispensing device includes an elongated flange contiguous with the chamber adjacent to at least one end thereof and overhanging the end of the support block of the apparatus when the base is disposed within the channel, said elongated flange including an aperture to receive said locating pin therethrough.

5. The apparatus of claim 1 wherein said locating pins are spaced from each other by the distance equal to the length of said closure.

6. The apparatus of claim 5 wherein the base of the medicinal dispensing device includes an elongated flange contiguous with the chamber adjacent to each end thereof and overhangs the associated end of the support block when the base is disposed within the channel, each of said elongated flanges including an aperture to receive an associated locating pin therethrough.

7. The apparatus of claim 6 wherein said press includes hand grip means for enabling pressure to be applied manually to the closure.

8. The apparatus of claim 7 wherein said contact face is formed of a resilient material.

9. The apparatus of claim 8 wherein said contact face is planar.

10. The apparatus of claim 9 wherein the contact face is formed of rubber.

* * * * *